US007099748B2

(12) United States Patent
Rayburn

(10) Patent No.: US 7,099,748 B2
(45) Date of Patent: Aug. 29, 2006

(54) HVAC START-UP CONTROL SYSTEM AND METHOD

(75) Inventor: Ronald Richard Rayburn, Norman, OK (US)

(73) Assignee: York International Corp., York, PA (US)

( * ) Notice: Subject to any disclaimer, the term of this patent is extended or adjusted under 35 U.S.C. 154(b) by 109 days.

(21) Appl. No.: 10/879,373

(22) Filed: Jun. 29, 2004

(65) Prior Publication Data

US 2005/0288822 A1 Dec. 29, 2005

(51) Int. Cl.
*G05D 23/00* (2006.01)

(52) U.S. Cl. ..... 700/276; 700/278; 236/1 C; 165/238

(58) Field of Classification Search ..... 700/276, 700/278; 236/1 C, 46 A, 46 R; 62/231; 165/238, 239

See application file for complete search history.

(56) References Cited

U.S. PATENT DOCUMENTS

| | | | | | |
|---|---|---|---|---|---|
| 4,071,745 | A | | 1/1978 | Hall | |
| 4,266,599 | A | | 5/1981 | Saunders et al. | |
| 4,497,031 | A | | 1/1985 | Froehling et al. | |
| 4,522,336 | A | | 6/1985 | Culp | |
| 4,557,317 | A | | 12/1985 | Harmon, Jr. | |
| 4,660,759 | A | * | 4/1987 | Barnard et al. | 236/46 R |
| 4,702,413 | A | | 10/1987 | Beckey et al. | |
| 4,706,882 | A | * | 11/1987 | Barnard | 236/46 R |
| 4,881,686 | A | | 11/1989 | Mehta | |
| 4,897,798 | A | * | 1/1990 | Cler | 236/46 R |
| 4,901,917 | A | | 2/1990 | Littell, III | |
| 4,931,948 | A | | 6/1990 | Parker et al. | |
| 5,115,967 | A | * | 5/1992 | Wedekind | 236/46 R |
| 5,192,020 | A | | 3/1993 | Shah | |
| 5,219,119 | A | | 6/1993 | Kasper et al. | |
| 5,270,952 | A | * | 12/1993 | Adams et al. | 700/278 |
| 5,361,983 | A | | 11/1994 | Bird | |
| 5,415,346 | A | | 5/1995 | Bishop | |
| 5,454,511 | A | | 10/1995 | Van Ostrand et al. | |
| 5,539,633 | A | * | 7/1996 | Hildebrand et al. | 700/32 |
| 5,555,927 | A | | 9/1996 | Shah | |
| 5,822,997 | A | * | 10/1998 | Atterbury | 62/180 |
| 6,145,751 | A | * | 11/2000 | Ahmed | 236/51 |

OTHER PUBLICATIONS

Honeywell, T8611M (7-Day Programming) Chronotherm III TM Heat Pump tHERMOSTATS, Oct. 1992, Form No. 68-0076-1.*

* cited by examiner

*Primary Examiner*—Jayprakash N. Gandhi
(74) *Attorney, Agent, or Firm*—McNees Wallace & Nurick LLC

(57) ABSTRACT

A controller controls operation of a HVAC&R device, bringing the temperature inside a structure from a first temperature to a second temperature at a predetermined time each day. Sensors sense the temperature both inside and outside the structure. A recovery time is calculated based upon a previously calculated air treatment rate of temperature recovery for the HVAC&R device to drive the temperature of the structure through a temperature change, the recovery time calculation being obtained by multiplying the difference between the sensed temperature inside the structure and the second temperature by the previously calculated air treatment rate. A correction factor is calculated based upon a relationship between the sensed outside temperature and a previously sensed outside temperature, the correction factor being added to obtain a corrected recovery time. The HVAC&R device is initiated at a time defined by the predetermined time subtracted from the corrected recovery time.

16 Claims, 3 Drawing Sheets

HVAC START-UP CONTROL SYSTEM AND METHOD

BACKGROUND OF THE INVENTION

The present invention relates generally to a control application for a HACK&R system. More specifically, the present invention relates to a system and method for start-up control of a HVAC&R system.

To minimize energy costs, a structure having a heating, ventilation, air conditioning and refrigeration (HVAC&R) or air treatment system for achieving climate control uses temperature settings that are initiated at HVAC times. For example, in warmer weather, the temperature setting for the structure is set at a higher level during unoccupied hours, and set at a lower level during occupied hours. This lower level temperature setting is an occupied set point or occupied setpoint temperature. It is desirable for the HVAC&R or air treatment system to achieve the occupied setpoint temperature at the start of the time period or setpoint time corresponding to the occupied hours, typically the start of a work shift. To accomplish this, the HVAC&R system must be initiated with sufficient time prior to the setpoint time to allow the HVAC&R system to cool the structure to the desired setpoint temperature, typically referred to as the recovery time. However, initiating the HVAC&R system too far in advance of the start of the setpoint time causes the HVAC&R system to reach the setpoint temperature before the setpoint time, thus wasting energy. Conversely, initiating the HVAC&R system too close to the setpoint time causes the HVAC&R system to achieve the setpoint temperature after the setpoint time has passed, subjecting the occupants in the structure to temperature settings that are outside their comfort level until the setpoint temperature is achieved.

One solution to this problem, U.S. Pat. No. 4,522,336 describes a start/stop controller for controlling an air treatment apparatus at a reduced energy consuming level during periods of non-occupancy of a building and for energizing the air treatment apparatus for occupancy so that the building is comfortable for occupancy. An adjustment time is calculated by taking the difference between the comfort temperature and the setback temperature, and then dividing this temperature difference by the rate of temperature change achieved by the air treatment apparatus. The rate of temperature change is obtained by calculating the temperature difference by the change in time. However, the controller of U.S. Pat. No. 4,522,336 is not adaptive, i.e., it does not take into account variations in the building, control system, or day-to-day differences in outside ambient temperature, and requires application of an arbitrary adjustment factor if the adjustment time falls outside a threshold range. One drawback of this technique is that the arbitrary adjustment factor, as disclosed, can act to increase the time differential between the time the setpoint temperature should be reached and the time the setpoint temperature is actually reached, providing inconsistent climate control inside the building.

What is needed is an adaptable startup control for use with HVAC&R systems that is simple to operate which can provide an optimized startup time for consistently achieving an occupied setpoint temperature at a daily predetermined setpoint time.

SUMMARY OF THE INVENTION

The present invention is directed to a method of controlling operation of a HVAC&R device to bring an interior temperature for a structure to a predetermined temperature setting at a predetermined time each day. The steps of the method include: sensing a temperature both inside and outside a structure; calculating a preliminary recovery time for a HVAC&R device to drive the sensed temperature inside the structure to a predetermined temperature setting, the preliminary recovery time calculation being obtained by multiplying a difference between the sensed temperature inside the structure and the predetermined temperature setting by a previously calculated air treatment rate; calculating a correction factor based upon multiplying a predetermined value by a difference between the sensed outside temperature and a previously sensed outside temperature; calculating a corrected recovery time based on a sum of the calculated preliminary recovery time and the correction factor; determining a starting time by subtracting the corrected recovery time from a predetermined time; and initiating operation of the HVAC&R device at the starting time.

The present invention further includes a controller for controlling operation of an HVAC&R device to bring an interior temperature for a structure to a predetermined temperature at a predetermined time each day. The controller includes a first sensor for sensing a temperature inside a structure and a second sensor for sensing a temperature outside the structure. A controller is responsive to the first and second sensors and to real time for determining optimum start/stop times so that the structure reaches the second predetermined temperature at substantially the first predetermined time. The controller calculates a preliminary recovery time for a HVAC&R device to drive the sensed temperature inside the structure to a predetermined temperature setting, the preliminary recovery time calculation being obtained by multiplying a difference between the sensed temperature inside the structure and the predetermined temperature setting by a previously calculated air treatment rate. The controller calculates a correction factor based upon multiplying a predetermined value by a difference between the sensed outside temperature and a previously sensed outside temperature, the controller calculating a corrected recovery time based on a sum of the calculated recovery time and the correction factor. The controller initiates operation of the HVAC&R device at a starting time defined by subtracting the corrected recovery time from a predetermined time.

One advantage of the present invention is that it is adaptive to day-to-day fluctuations in outside ambient temperature.

Another advantage of the present invention is that it requires a minimum number of data values saved to memory.

A further advantage of the present invention is that it saves energy by initiating operation of a HVAC&R system to achieve a setpoint temperature at a daily predetermined setpoint time.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
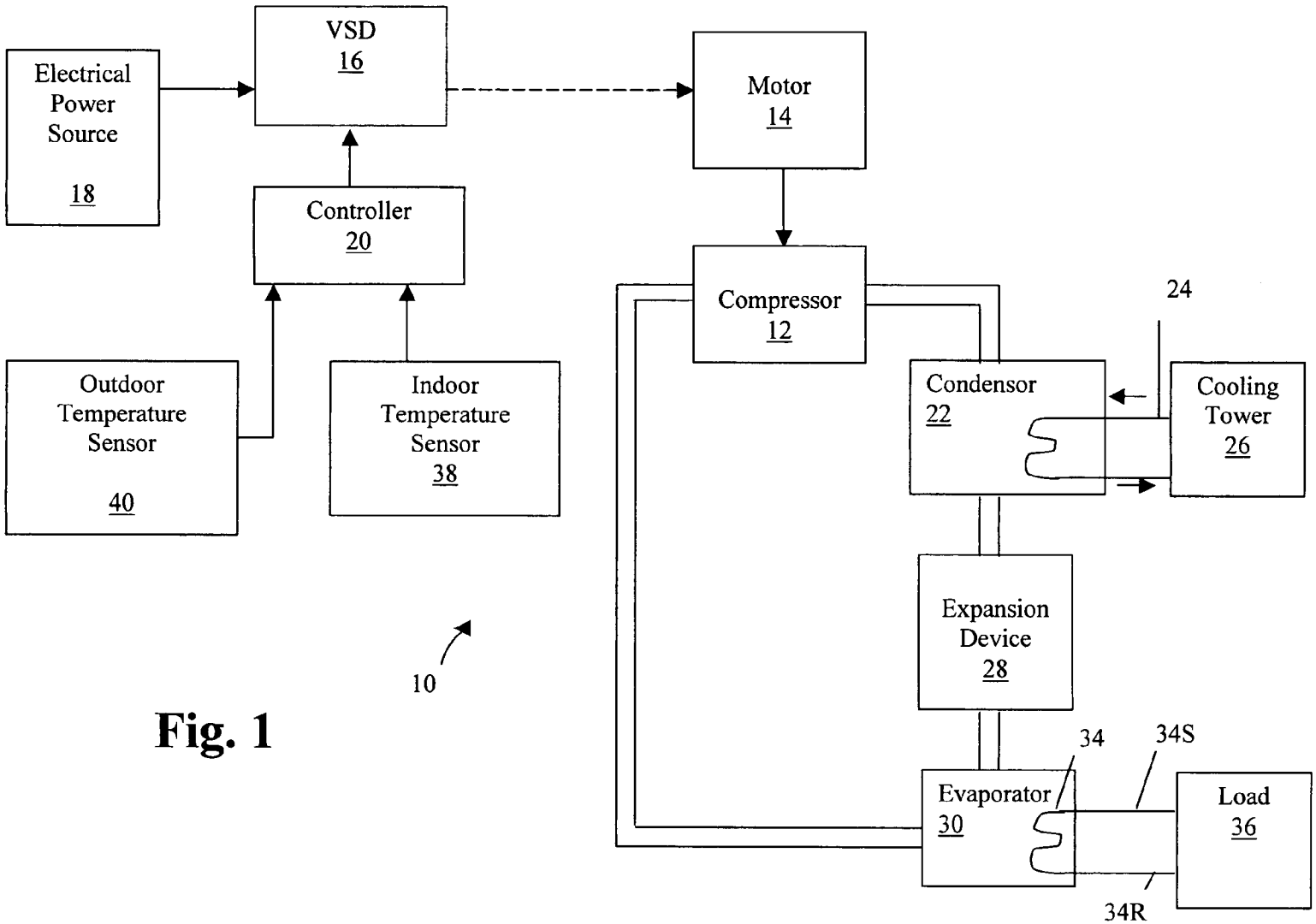
FIG. 1 illustrates schematically an embodiment of a heating, ventilation and air conditioning system for use with the present invention.

One embodiment of the heating, ventilation and air conditioning or refrigeration (HVAC&R) system 10 of the present invention is depicted in FIG. 1. Compressor 12 is connected to a motor 14 and inverter or variable speed drive (VSD) 16, for selectively controlling operational parameters, such as rotational speed, of the compressor 12. Compressor 12 is typically a positive displacement compressor, such as screw, reciprocating or scroll, having a wide range of cooling capacity, although any type of compressor may also be used. The controller 20 includes logic devices, such as a microprocessor or other electronic means, for controlling the operating parameters of compressor 12 by controlling VSD 16 and motor 14. AC electrical power received from an electrical power source 18 is rectified from AC to DC, and then inverted from DC back to variable frequency AC by VSD 16 for driving compressor motor 14. The compressor motor 14 is typically AC induction, but might also be Brushless Permanent Magnet or Switched Reluctance motors.

Refrigerant gas that is compressed by compressor 12 is directed to the condenser 22, which enters into a heat exchange relationship with a fluid, preferably water, flowing through a heat-exchanger coil 24 connected to a cooling tower 26. The refrigerant vapor in the condenser 22 undergoes a phase change to a refrigerant liquid as a result of the heat exchange relationship with the liquid in the heat-exchanger coil 24. The condensed liquid refrigerant from condenser 22 flows to an expansion device 28, which greatly lowers the temperature and pressure of the refrigerant before entering the evaporator 30. Alternately, the condenser 22 can reject the heat directly into the atmosphere through the use of air movement across a series of finned surfaces (direct expansion condenser).

The evaporator 30 can include a heat-exchanger coil 34 having a supply line 34S and a return line 34R connected to a cooling load 36. The heat-exchanger coil 34 can include a plurality of tube bundles within the evaporator 30. Water or any other suitable secondary refrigerant, e.g., ethylene, calcium chloride brine or sodium chloride brine, travels into the evaporator 30 via return line 34R and exits the evaporator 30 via supply line 34S. The liquid refrigerant in the evaporator 30 enters into a heat exchange relationship with the water in the heat-exchanger coil 34 to chill the temperature of the water in the heat-exchanger coil 34. The refrigerant liquid in the evaporator 30 undergoes a phase change to a refrigerant gas as a result of the heat exchange relationship with the liquid in the heat-exchanger coil 34. The gas refrigerant in the evaporator 30 then returns to the compressor 12.

Controller 20, which controls the operations of system 10, employs continuous feedback from indoor temperature sensor 38 and outdoor ambient temperature sensor 40 preferably in real time to continuously monitor whether to initiate operation of the system 10 to achieve a predetermined temperature, or setpoint temperature, such as an occupied setpoint temperature, at a predetermined setpoint time every day. For example, in a structure, such as a commercial building primarily occupied during a first shift, such as from 8:00 a.m. to 6:00 p.m., it may be desirable to impose different temperature/time settings in order to reduce energy costs associated with using the system 10 for climate control. Typically during occupancy, it is desirable to maintain the structure at about 72° F. when heating is required, and about 68° F. when cooling is required for at least the predominantly occupied time period, and perhaps somewhat longer in the evenings to accommodate cleaning or other maintenance personnel, such as to about 8:00 p.m. However, between 8:01 p.m. and some time before occupancy at 8:00 a.m. the next day, appreciable energy savings can be realized if between these hours, the structure has different control settings input into the controller, such as about 60° F. when heating is required, and 85° F. when cooling is required. At some time prior to the time of occupancy at 8:00 a.m. or setpoint time, system 10 must be initiated in order to bring the temperature in the structure to the occupancy temperature, or setback temperature substantially at the occupancy time or setpoint time.

The first time the HVAC&R system 10 is operated, the controller 20 initially has no historical data with which to work to achieve the setpoint temperature "$T_{SP}$" at approximately the setpoint time "$t_{sp}$". An arbitrary system initiation time is selected, such as one hour prior to the setpoint time. Therefore, in the present example, the controller 20 would initiate operation of the HVAC&R system 10 at 7:00 a.m. It is to be understood that the controller 20 is configured to operate when the structure requires either heating or cooling. The HVAC&R system 10 is then permitted to run continuously in either heating or cooling mode until the setpoint temperature is reached. The controller 20 includes a timer that measures the time "$t_1$" required for the HVAC&R system 10 to bring the temperature inside the structure "$T_{IN}$" as sensed by indoor temperature sensor 38 to the setpoint temperature $T_{SP}$. An air treatment rate "ATR" is then calculated by dividing the measured operating time $t_1$ of the HVAC&R system 10 by the absolute value of the difference in temperature from the inside temperature $T_{IN}$ sensed by the indoor temperature sensor 38 and the setpoint temperature $T_{SP}$ as shown in equation [1].

$$ATR=t_1/|T_{SP}-T_{IN}| \quad [1]$$

Air treatment rate ATR is expressed in units of time divided by temperature, such as minutes/° F. Therefore, if the difference between the setpoint temperature $T_{SP}$ and the indoor temperature $T_{IN}$ as sensed by the indoor temperature sensor 38 is twelve degrees, and the HVAC&R system 10 is required to operate for 48 minutes to achieve the setpoint temperature $T_{SP}$, the air treatment rate ATR is 4 minutes per/° F. The 48 minute time value is referred to as the recovery time. Preferably, the air treatment rate ATR is stored in a memory device that is provided in the controller 20.

Once the air treatment rate ATR is initially calculated, it can be applied to calculate a recovery time "$t_r$" of the HVAC&R system 10 for a subsequent day of operation. For example, if during the next day of operation, the difference between the inside temperature $T_{IN}$ and the setpoint temperature $T_{SP}$ was 16 degrees, a recovery time $t_r$ is calculated by multiplying the temperature difference between $T_{IN}$ and $T_{SP}$ by the air treatment rate ATR as shown in equation [2].

$$t_r=|T_{SP}-T_{IN}|\times ATR \quad [2]$$

In the present example, the recovery time $t_r$ is 64 minutes. Therefore, the controller 20, which preferably maintains a real time measuring capability, calculates the recovery time $t_r$ and compares the recovery time $t_r$ with the time remaining "$t_{rem}$" prior to the setpoint time $t_{sp}$. If the time remaining $t_{rem}$ prior to the setpoint time $t_{sp}$ is less than or equal to the recovery time $t_r$, the controller 20 initiates operation of the HVAC&R system 10. However, if the time remaining $t_{rem}$ prior to the setpoint time $t_{SP}$ is greater than the recovery time $t_r$, the controller 20 does not initiate operation of the HVAC&R system 10.

Once the time remaining $t_{rem}$ prior to the setpoint time $t_{sp}$ is less than or equal to the recovery time $t_r$, the controller 20 initiates operation of the HVAC&R system 10. The duration of the operating time of the HVAC&R system 10 to reach the setpoint temperature $T_{SP}$ is again measured and the new air treatment rate ATR replaces the prior ATR stored in memory provided in the controller 20. Preferably, to simplify operation of the controller and minimize memory requirements, the most recently calculated air treatment rate ATR is saved to the memory address or location having the previously calculated air treatment rate ATR. However, if desired, the most recently calculated air treatment rate ATR may be combined with a previously calculated air treatment rate ATR by averaging their values, or any other technique of calculating and combining air treatment rates may be employed.

The technique of applying the most recently calculated air treatment rate ATR value to determine a recovery time $t_r$ produces reasonably consistent results when the outside ambient temperatures "$T_{OUT}$" are relatively constant. Preferably, the outside ambient temperatures $T_{OUT}$ are measured by the outdoor temperature sensor 40 when operation of the HVAC&R system 10 is initiated, which is substantially at the same time each day. However, significant fluctuations in outside ambient temperatures $T_{OUT}$, especially between outside ambient temperatures $T_{OUT}$ measured by the outdoor temperature sensor 40 on consecutive days, can significantly affect the recovery time $t_r$. To account for this fluctuation in outside ambient temperatures $T_{OUT}$, a relationship between the difference between outside ambient temperatures $T_{OUT}$ measured on consecutive days is included in the calculation for recovery time $t_r$. In such a relationship, the outside ambient temperatures $T_{OUT}$ is measured each day, e.g., $T_{OUT1}$ for day one and $T_{OUT2}$ for day two, and preferably each value is saved to a memory device provided on the controller 20. The difference between the outside ambient temperatures $T_{OUT1}$, $T_{OUT2}$ measured on consecutive days by the outdoor temperature sensor 40 is multiplied by a factor, such as 0.5, as shown in equation [3] and further simplified in equation [4] to obtain an adaptable relationship for calculating recovery time $t_r$.

$$t_r=|T_{SP}-T_{IN}|\times ATR-(0.5\times(T_{OUT2}-T_{OUT1})\times(T_{SP}-T_{IN})/|T_{SP}-T_{IN}|) \quad [3]$$

$$t_r=t_1-(0.5\times(T_{OUT2}-T_{OUT1})\times(T_{SP}-T_{IN})\ /|T_{SP}-T_{IN}|) \quad [4]$$

Using a factor of 0.5 in equation [3] as applied to the difference between the outside ambient temperatures $T_{OUT1}$, $T_{OUT2}$, every two degree difference between the measured outside ambient temperatures $T_{OUT1}$, $T_{OUT2}$ then results in a one minute correction to the recovery time $t_r$ calculated in equation [2]. Although the 0.5 factor is used in a preferred embodiment, it is to be understood that factor values other than 0.5 or ratios of other variables may also be applied. The correction is either added to or subtracted from the recovery time $t_r$, depending both on whether the second day outside ambient temperature $T_{OUT2}$ is greater than the first day outside ambient temperature $T_{OUT1}$ and whether the structure is being heated or cooled. When the second day outside ambient temperature $T_{OUT2}$ is greater than the first day outside ambient temperature $T_{OUT1}$, the recovery time $t_r$ is decreased when the structure is being heated. Conversely, when the second day outside ambient temperature $T_{OUT2}$ is less than the first day outside ambient temperature $T_{OUT1}$, the recovery time $t_r$ is increased when the structure is being heated. Of course, these relationships are reversed when the structure is being cooled.

Factoring in the relationship between outside ambient temperatures $T_{OUT1}$, $T_{OUT2}$ provides a more consistently accurate calculation of recovery time $t_r$ for either heating and cooling modes such that the HVAC&R system 10 consistently achieves the setpoint temperature within about five minutes of the setpoint time. In addition, this relationship is substantially unchanged when an economizer is used to more economically cool the structure. That is, when the outside ambient temperature $T_{OUT}$ and humidity conditions are favorable to draw outside ambient temperature $T_{OUT}$ air into the structure, such as when the outside ambient temperature $T_{OUT}$ air is between about 55–60° F., the recovery time $t_r$ is essentially unchanged.

The controller 20 can include an analog to digital (A/D) converter, a microprocessor, a non-volatile memory, and an interface board to control operation of the HVAC&R system 10. The controller 20 can also be used to control the operation of the VSD 16, the motor 14 and the compressor 12. The controller 20 executes a control algorithm(s) or software to control operation of the system 10. In one embodiment, the control algorithm(s) can be computer programs or software stored in the non-volatile memory of the controller 20 and can include a series of instructions executable by the microprocessor of the controller 20. While it is preferred that the control algorithm be embodied in a computer program(s) and executed by the microprocessor, it is to be understood that the control algorithm may be implemented and executed using digital and/or analog hardware by those skilled in the art. If hardware is used to execute the control algorithm, the corresponding configuration of the controller 20 can be changed to incorporate the necessary components and to remove any components that may no longer be required.

Figure 2:
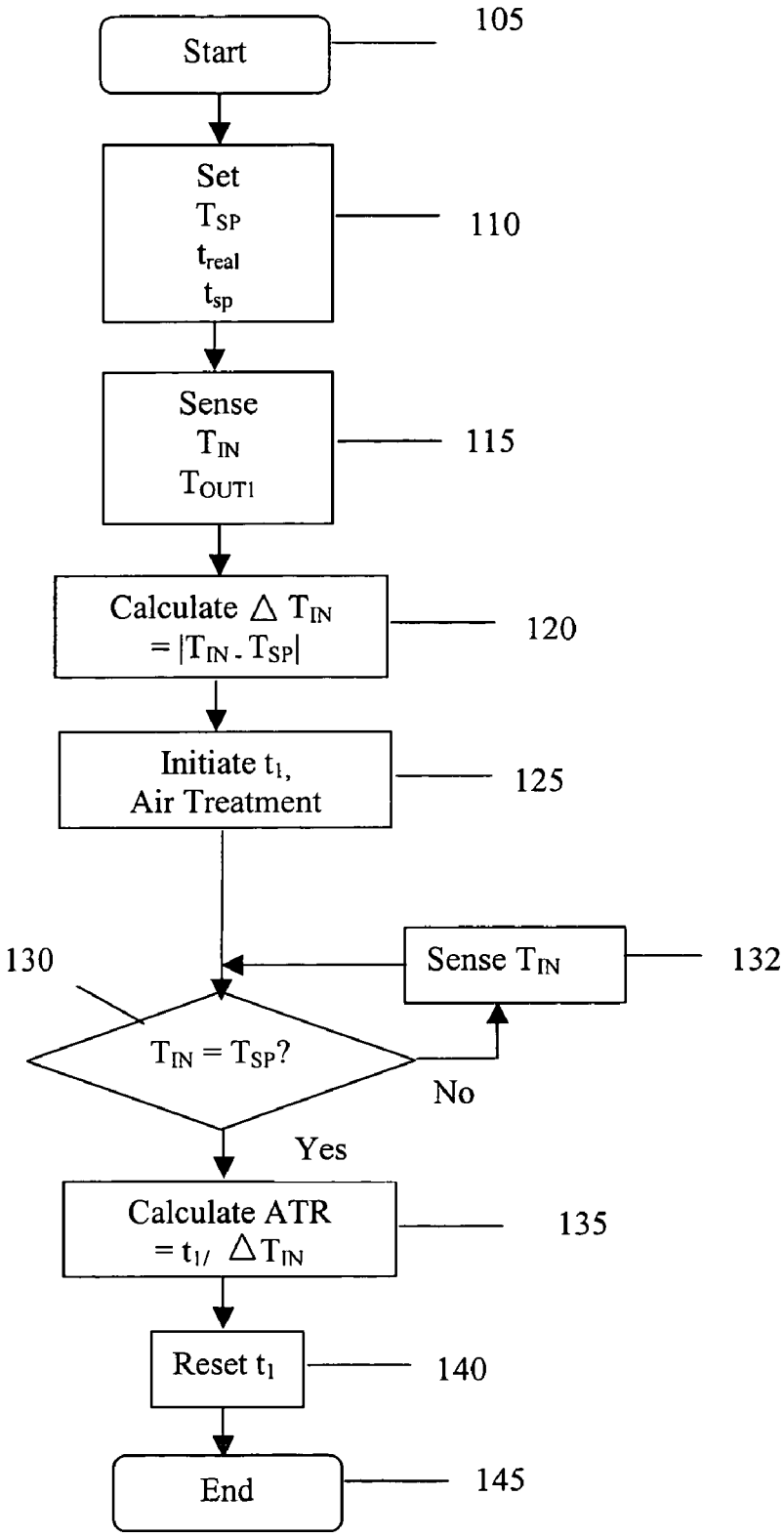
FIGS. 2–3 illustrate a flow chart detailing the heating control method of the present invention.
Figure 3:
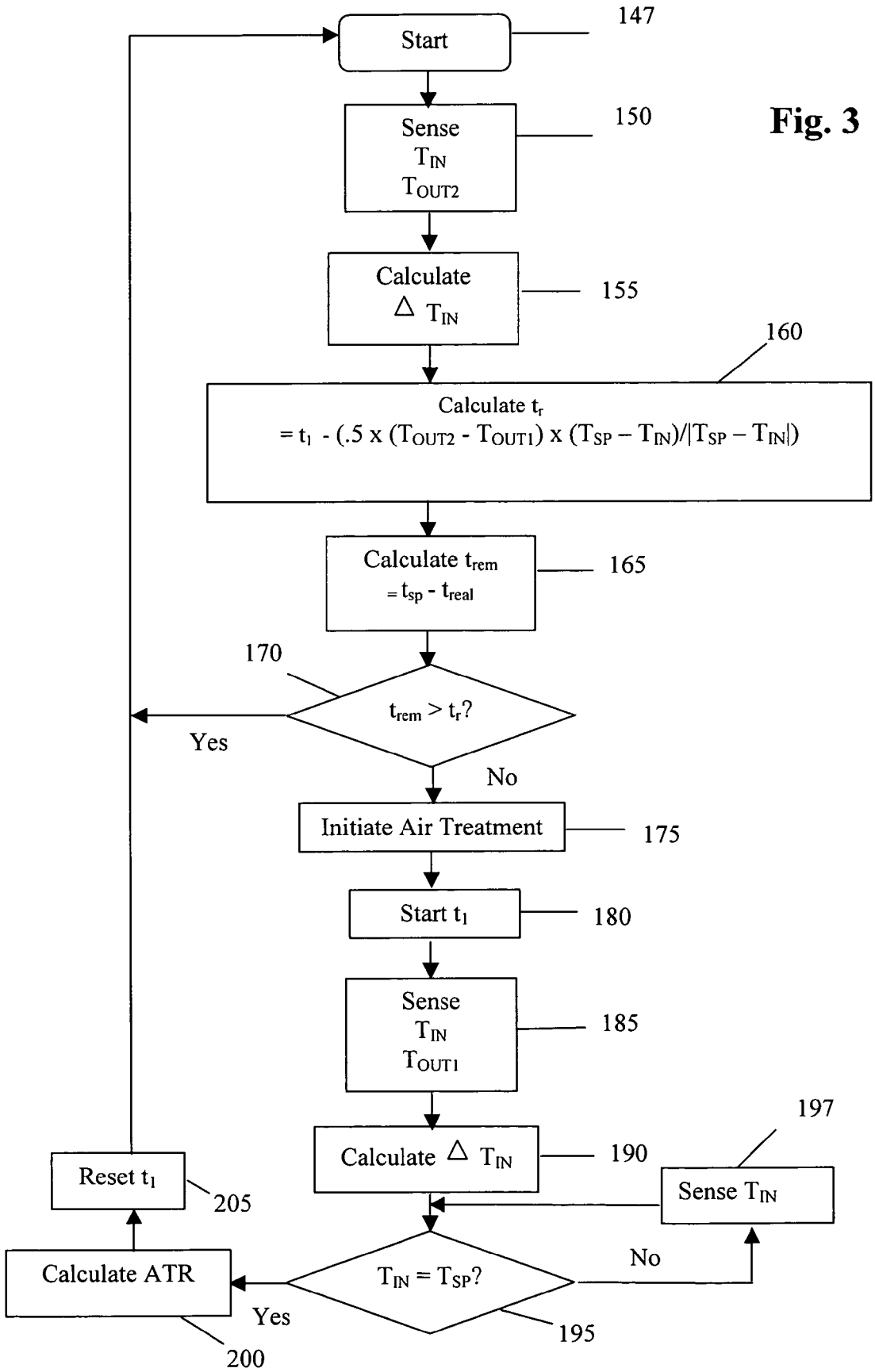

FIGS. 2–3 illustrate a flow chart detailing the control process of the present invention relating to heating or cooling control in an HVAC&R system 10, as shown in FIG. 1, wherein control is maintained by the thermostat (not shown). The heating/cooling control process of FIG. 2 can also be implemented as a separate control program executed by a microprocessor, or control panel, or controller 20 or the control process can be implemented as a sub-program in the control program for the HVAC&R system 10. FIG. 2 illustrates a flow chart for the initialization, or first day, for the control process, while FIG. 3 illustrates the flow chart for the second and subsequent days for the control process. Once the process is started in step 105 of FIG. 2, values are selected and set for the setpoint temperature $T_{SP}$, real time $t_{real}$ and setpoint time $t_{sp}$ in step 110. After the setpoint temperature $T_{SP}$, real time $t_{real}$ and setpoint time $t_{sp}$ are set, the temperature inside the structure $T_{IN}$ and the outside ambient temperature for the first day $T_{OUT1}$ are measured in step 115, the outside ambient temperature for the first day $T_{OUT1}$ being saved to memory as previously discussed. Once the temperature inside the structure $T_{IN}$ and the outside ambient temperature for the first day $T_{OUT1}$ are measured, the absolute value of the difference between the temperature inside the structure $T_{IN}$ and the setpoint temperature $T_{SP}$ is calculated in step 120, this temperature difference being referred to as the inside temperature difference $\Delta T_{IN}$.

After the inside temperature difference $\Delta T_{IN}$ has been calculated, both a timer $t_1$ and the HVAC&R system 10 are initiated in step 125. For the first initiation of the HVAC&R system 10, the starting time, in real time $t_{real}$, is manually selected by the operator, such as at a time about one hour prior to the setpoint time $t_{sp}$. If desired, an initial starting time offset from the selected setpoint time $t_{sp}$ could be programmed into the control operation of the system 10. After the timer $t_1$ and the HVAC&R system 10 are initiated in step 125, the temperature inside the structure $T_{IN}$ is compared with the setpoint temperature $T_{SP}$ in step 130. If the temperature inside the structure $T_{IN}$ is not equal to the setpoint temperature $T_{SP}$, the temperature inside the structure $T_{IN}$ is sensed in step 132, and control of the process is returned to step 130. However, if the temperature inside the structure $T_{IN}$ is equal to the setpoint temperature $T_{SP}$, the air treatment rate ATR is calculated in step 135, which is the elapsed time of the timer $t_1$ divided by the inside temperature difference $\Delta T_{IN}$. Once the air treatment rate ATR is calculated, the timer $t_1$ is reset in step 140, and the initialization of the control process ends at step 145.

The next day, the operation of the control process is resumed, starting in step 147 of FIG. 3. It is realized that values set from FIG. 2, the previous day's operation, are also to be used in FIG. 3. After the control process is started in step 147, the temperature inside the structure $T_{IN}$ and the outside ambient temperature $T_{OUT2}$ are sensed by respective sensors 38, 40 in step 150. The outside ambient temperature $T_{OUT2}$ is stored to a portion of memory that is independent of the earlier measured outside ambient temperature $T_{OUT1}$. In other words, the sensed outside ambient temperature $T_{OUT2}$ is not saved over the memory location at which the earlier measured outside ambient temperature $T_{OUT1}$ is stored. However, the temperature inside the structure $T_{IN}$ sensed in step 150 is preferably saved over the memory location of the temperature inside the structure $T_{IN}$ sensed in step 115. Once the temperature inside the structure $T_{IN}$ and the outside ambient temperature $T_{OUT2}$ are sensed, the inside temperature difference $\Delta T_{IN}$ is calculated in step 155. After the inside temperature difference $\Delta T_{IN}$ is calculated, the recovery time $t_r$ as shown in equation [4] is calculated in step 160. Subsequent of the calculation of the recovery time $t_r$, the time remaining $t_{rem}$ until the setpoint time $t_{sp}$, which is the difference between the setpoint time $t_{sp}$, and the current time in real time $t_{real}$, is calculated in step 165.

Once the time remaining $t_{rem}$ until the setpoint time $t_{sp}$ is calculated, the time remaining $t_{rem}$ until the setpoint time $t_{sp}$ is compared to the recovery time $t_r$ in step 170. If the time remaining $t_{rem}$ until the setpoint time $t_{sp}$ is greater than the recovery time $t_r$, control of the process is returned to step 147, then to steps 155–165 as previously discussed. However, if the time remaining $t_{rem}$ until the setpoint time $t_{sp}$ is not greater than the recovery time $t_r$, control of the process is returned to step 175 in which the HVAC&R system 10 is initiated. After the HVAC&R system 10 is initiated, the timer $t_1$ is started in step 180. Once the timer $t_1$ is started, the temperature inside the structure $T_{IN}$ and the outside ambient temperature $T_{OUT1}$ are sensed in step 185. Preferably, the sensed temperature inside the structure $T_{IN}$ and the outside ambient temperature $T_{OUT1}$ are preferably saved over the respective memory locations of the temperature inside the structure $T_{IN}$ sensed in step 150 and the outside ambient temperature $T_{OUT1}$ sensed in step 115. After the temperature inside the structure $T_{IN}$ and the outside ambient temperature $T_{OUT1}$ are sensed in step 185, the inside temperature difference $\Delta T_{IN}$ is calculated in step 190. Once the inside temperature difference $\Delta T_{IN}$ is calculated, the temperature inside the structure $T_{IN}$ is compared to the setpoint temperature $T_{SP}$ in step 195. If the temperature inside the structure $T_{IN}$ is not equal to the setpoint temperature $T_{SP}$, the temperature inside the structure $T_{IN}$ is sensed in step 197, and control of the process is returned to step 195. However, if the temperature inside the structure $T_{IN}$ is equal to the setpoint temperature $T_{SP}$, control of the process is returned to step 200. In step 200 the air treatment rate ATR is calculated, and in step 205 timer $t_1$ is reset. After the timer $t_1$ is reset, control of the process is returned to step 147, wherein the process between steps 150–205 is repeated.

In addition to use with commercial HVAC&R systems, including roof-mounted configurations, the control process of the present invention can also be used with residential units wherein a setpoint temperature has a setpoint time that occurs at substantially the same time of the day. The residential units include split systems where the condenser is located outside the structure. Additionally, the process of the present invention is usable with an HVAC&R system that is capable of variable capacity operation, in that the heating/cooling demands of a structure typically remains substantially the same if the setpoint time remains substantially the same. Absent an intervening circumstance, such as leaving windows or doors of the structure open to the outside ambient air, having an unusually large number of persons or other sources having high heat output or heat sink are placed in the structure, the control system of the present invention otherwise corrects for fluctuations in outside ambient temperatures used in the calculations of recovery time $t_r$.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of controlling operation of a heating, ventilation, air conditioning and refrigeration (HVAC&R) device to bring an interior temperature for a structure to a predetermined temperature setting at a predetermined time each day, the method comprising the steps of:

sensing a temperature both inside and outside a structure;

calculating a preliminary recovery time for an HVAC&R device to drive the sensed temperature inside the structure to a predetermined temperature setting, the preliminary recovery time calculation being obtained by multiplying a difference between the sensed temperature inside the structure and the predetermined temperature setting by a previously calculated air treatment rate;

calculating a correction factor based upon multiplying a predetermined value by a difference between the sensed outside temperature and a previously sensed outside temperature;

calculating a corrected recovery time based on a sum of the calculated preliminary recovery time and the correction factor;

determining a starting time by subtracting the corrected recovery time from a predetermined time; and initiating operation of the HVAC&R device at the starting time.

2. The method of claim 1 further comprising an additional step of:

sensing the temperature both inside and outside the structure;

initiating operation of the HVAC&R device at a first starting time;

terminating operation of the HVAC&R device when the HVAC&R device has brought the interior temperature of the structure to a desired temperature;

recording an operating time duration of the HVAC&R device between the time of initiating operation and terminating operation;

dividing the operating time duration by the difference between the desired temperature and the sensed temperature inside the structure at substantially the first starting time.

3. The method of claim 1 wherein the step of calculating a corrected recovery time includes calculating a recovery time based upon a previously calculated air treatment rate of temperature recovery obtained from the previous day of operation of the HVAC&R device.

4. The method of claim 1 wherein the step of calculating a corrected recovery time includes calculating a recovery time based upon a previously calculated air treatment rate of temperature recovery obtained by combining a predetermined number of previously calculated air treatment rates.

5. The method of claim 1 wherein the step of calculating a corrected recovery time includes calculating a recovery time based upon a previously calculated air treatment rate of temperature recovery obtained by averaging a predetermined number of previously calculated air treatment rates.

6. The method of claim 1 wherein the predetermined value is 0.5.

7. The method of claim 1 wherein the correction factor can be a negative value.

8. The method of claim 1 wherein the step of calculating a correction factor includes calculating a correction factor based upon multiplying a predetermined value by the difference between the sensed outside temperature and a previously sensed outside temperature from the previous day.

9. The method of claim 8 wherein the previously sensed outside temperature from the previous day is measured at substantially a time defined by the corrected recovery time subtracted from the predetermined time.

10. A controller for controlling operation of a heating, ventilation, air conditioning and refrigeration (HVAC&R) device to bring an interior temperature for a structure to a predetermined temperature at a first predetermined time each day, the controller comprising:

a first sensor for sensing a temperature inside a structure and a second sensor for sensing a temperature outside the structure;

a controller responsive to the first and second sensors and to real time for determining optimum start/stop times so that the structure reaches a second predetermined temperature at substantially the first predetermined time, the controller calculating a preliminary recovery time for an HVAC&R device to drive the sensed temperature inside the structure to a predetermined temperature setting, the preliminary recovery time calculation being obtained by multiplying a difference between the sensed temperature inside the structure and the predetermined temperature setting by a previously calculated air treatment rate, the controller calculating a correction factor based upon multiplying a predetermined value by a difference between the sensed outside temperature and a previously sensed outside temperature, the controller calculating a corrected recovery time based on a sum of the calculated preliminary recovery time and the correction factor; and wherein the controller initiates operation of the HVAC&R device at a starting time defined by subtracting the corrected recovery time from a first predetermined time.

11. The controller of claim 10 wherein the previously calculated air treatment rate of temperature recovery for the HVAC&R device is obtained from the previous day of operation of the HVAC&R device.

12. The controller of claim 10 wherein the previously calculated air treatment rate of temperature recovery for the HVAC&R device is obtained by combining a predetermined number of previously calculated air treatment rates.

13. The controller of claim 10 wherein the previously calculated air treatment rate of temperature recovery for the HVAC&R device is obtained by averaging a predetermined number of previously calculated air treatment rates.

14. The controller of claim 10 wherein the correction value is based on a predetermined value is 0.5.

15. The controller of claim 14 wherein the previously sensed outside temperature is obtained from the previous day of operation.

16. The controller of claim 15 wherein the previously sensed outside temperature is measured at substantially a time defined by the corrected recovery time subtracted from the first predetermined time.

* * * * *